US008961159B2

(12) United States Patent
Seong et al.

(10) Patent No.: US 8,961,159 B2
(45) Date of Patent: Feb. 24, 2015

(54) SCROLL COMPRESSOR

(71) Applicants: Sanghun Seong, Seoul (KR); Byeongchul Lee, Seoul (KR); Hakyoung Kim, Seoul (KR); Jaesang Lee, Seoul (KR)

(72) Inventors: Sanghun Seong, Seoul (KR); Byeongchul Lee, Seoul (KR); Hakyoung Kim, Seoul (KR); Jaesang Lee, Seoul (KR)

(73) Assignee: LG Electronics Inc., Seoul (KR)

( * ) Notice: Subject to any disclaimer, the term of this patent is extended or adjusted under 35 U.S.C. 154(b) by 158 days.

(21) Appl. No.: 13/649,310

(22) Filed: Oct. 11, 2012

(65) Prior Publication Data

US 2013/0115123 A1 May 9, 2013

(30) Foreign Application Priority Data

Oct. 12, 2011 (KR) ..... 10-2011-0104308

(51) Int. Cl.

| | |
|---|---|
| ***F04C 18/02*** | (2006.01) |
| ***F04C 29/12*** | (2006.01) |
| ***F04C 23/00*** | (2006.01) |
| ***F04C 29/06*** | (2006.01) |

(52) U.S. Cl.

CPC ..... *F04C 29/12* (2013.01); *F04C 18/0269* (2013.01); *F04C 23/008* (2013.01); *F04C 29/06* (2013.01); *F04C 18/0215* (2013.01)

USPC ..... 418/55.2; 418/55.1; 418/55.4

(58) Field of Classification Search

CPC ..... F04C 18/0269; F04C 18/0253–18/0261; F04C 29/06; F04C 29/068; F04C 29/12; F04C 29/126

USPC ..... 418/55.1–55.4

See application file for complete search history.

(56) References Cited

U.S. PATENT DOCUMENTS

| | | | | |
|---|---|---|---|---|
| 4,303,379 | A | 12/1981 | Hiraga et al. | 418/55 |
| 4,655,696 | A | 4/1987 | Utter | 418/55 |
| 4,774,816 | A | 10/1988 | Uchikawa et al. | 418/55.1 |
| 5,017,108 | A | 5/1991 | Murayama et al. | 418/55.6 |
| 5,775,893 | A * | 7/1998 | Takao et al. | 418/55.2 |

(Continued)

FOREIGN PATENT DOCUMENTS

| | | |
|---|---|---|
| CN | 1138669 | 12/1996 |
| CN | 1197165 | 10/1998 |

(Continued)

OTHER PUBLICATIONS

European Search Report dated Jan. 28, 2014, issued in Application No. 12 18 5162.

(Continued)

*Primary Examiner* — Thomas Denion
*Assistant Examiner* — Xiaoting Hu
(74) *Attorney, Agent, or Firm* — Ked & Associates, LLP

(57) ABSTRACT

A scroll compressor may include a blocking portion provided in a fixed component thereof, and positioned adjacent to a discharge hole formed in an orbiting scroll of the compressor. The blocking portion may temporarily obscure the discharge hole upon initiation of a discharging operation, thereby preventing refrigerant discharged into a discharging space from flowing back into a compression chamber, without the use of a separate check valve. Such a blocking portion may prevent an increase in overall compressor noise due to noise typically generated by a check valve. Such a blocking portion may also prevent degradation in compressor reliability levels due to valve damage and increases in fabricating costs due to the addition of the valve.

18 Claims, 15 Drawing Sheets

(56) References Cited

U.S. PATENT DOCUMENTS

| | | | | |
|---|---|---|---|---|
| 5,800,141 | A | 9/1998 | Ceylan et al. | 418/55.1 |
| 6,030,192 | A * | 2/2000 | Hill et al. | 418/55.2 |
| 6,053,714 | A | 4/2000 | Fenocchi et al. | 418/55.1 |
| 6,301,912 | B1 * | 10/2001 | Terai et al. | 62/228.4 |
| 6,379,131 | B1 * | 4/2002 | Hoashi | 417/440 |
| 6,464,470 | B1 * | 10/2002 | Zamudio et al. | 417/297 |
| 6,579,080 | B1 * | 6/2003 | Spinnler | 418/55.2 |
| 6,932,586 | B2 * | 8/2005 | Furusho et al. | 418/55.5 |
| 7,371,059 | B2 * | 5/2008 | Ignatiev et al. | 418/151 |
| 7,909,592 | B2 * | 3/2011 | Yano et al. | 418/55.1 |
| 8,308,460 | B2 | 11/2012 | Seong et al. | 418/55.2 |
| 2001/0014293 | A1 * | 8/2001 | Tsumagari et al. | 418/55.4 |
| 2002/0039540 | A1 * | 4/2002 | Kuroki et al. | 418/55.5 |
| 2006/0159567 | A1 | 7/2006 | Tazoe et al. | 417/410.3 |
| 2012/0134864 | A1 * | 5/2012 | Lee et al. | 418/66 |
| 2012/0230855 | A1 * | 9/2012 | Seong et al. | 418/55.2 |

FOREIGN PATENT DOCUMENTS

| | | | |
|---|---|---|---|
| CN | 101144474 | | 3/2008 |
| CN | 101517237 | | 8/2009 |
| CN | 103016342 | | 5/2013 |
| CN | 103075342 | | 5/2013 |
| DE | 100 09 673 | A1 | 9/2000 |
| EP | 0 348 936 | A2 | 1/1990 |
| EP | 1 507 085 | A1 | 2/2005 |
| GB | 2 167 132 | A | 5/1986 |
| JP | 2-019678 | | 1/1990 |
| JP | 7-269478 | | 10/1995 |
| JP | 09-032750 | | 2/1997 |
| JP | 10-246188 | | 9/1998 |
| JP | 2000-18179 | | 1/2000 |
| JP | 2001-182677 | | 7/2001 |
| JP | 2002-89463 | | 3/2002 |
| JP | 2004-060502 | | 2/2004 |
| JP | 2007-100713 | | 4/2007 |
| KR | 10-0311888 | | 9/2001 |
| KR | 10-0395163 | | 8/2003 |
| KR | 10-2009-0077294 | | 7/2009 |
| KR | 10-1059880 | | 8/2011 |
| WO | WO 96/20345 | A1 | 7/1996 |
| WO | WO 2007/114531 | A1 | 10/2007 |

OTHER PUBLICATIONS

European Search Report dated Jan. 29, 2014, issued in Application No. 12 18 5161.

United States Office Action dated Nov. 25, 2013 issued in U.S. Appl. No. 13/454,152.

United States Office Action dated Dec. 4, 2013 issued in U.S. Appl. No. 13/454,137.

Final Office Action dated May 20, 2014, issued in U.S. Appl. No. 13/454,137.

Office Action dated Jun. 5, 2014, issued in U.S. Appl. No. 13/598,673.

Chinese Office Action dated Nov. 2, 2014. (English Translation).

Chinese Office Action dated Nov. 18, 2014. (English Translation).

* cited by examiner (d)

SCROLL COMPRESSOR

CROSS-REFERENCE TO RELATED APPLICATION(S)

This application claims priority under 35 U.S.C. §119 to Korean Application No. 10-2011-0104308 filed on Oct. 12, 2011, whose entire disclosure(s) is/are hereby incorporated by reference.

BACKGROUND

1. Field

This specification relates to a scroll compressor.

2. Background

A scroll compressor may include a fixed scroll having a fixed wrap, and an orbiting scroll having an orbiting wrap engaged with the fixed wrap. In such a scroll compressor, as the orbiting scroll orbits on the fixed scroll, the volumes of compression chambers, which are formed between the fixed wrap and the orbiting wrap, consecutively change, thereby sucking and compressing a refrigerant. The scroll compressor allows suction, compression and discharge to be consecutively performed, and thus may generate reduced levels of vibration and noise during operation.

BRIEF DESCRIPTION OF THE DRAWINGS

The embodiments will be described in detail with reference to the following drawings in which like reference numerals refer to like elements wherein.

DETAILED DESCRIPTION

Figure 1:
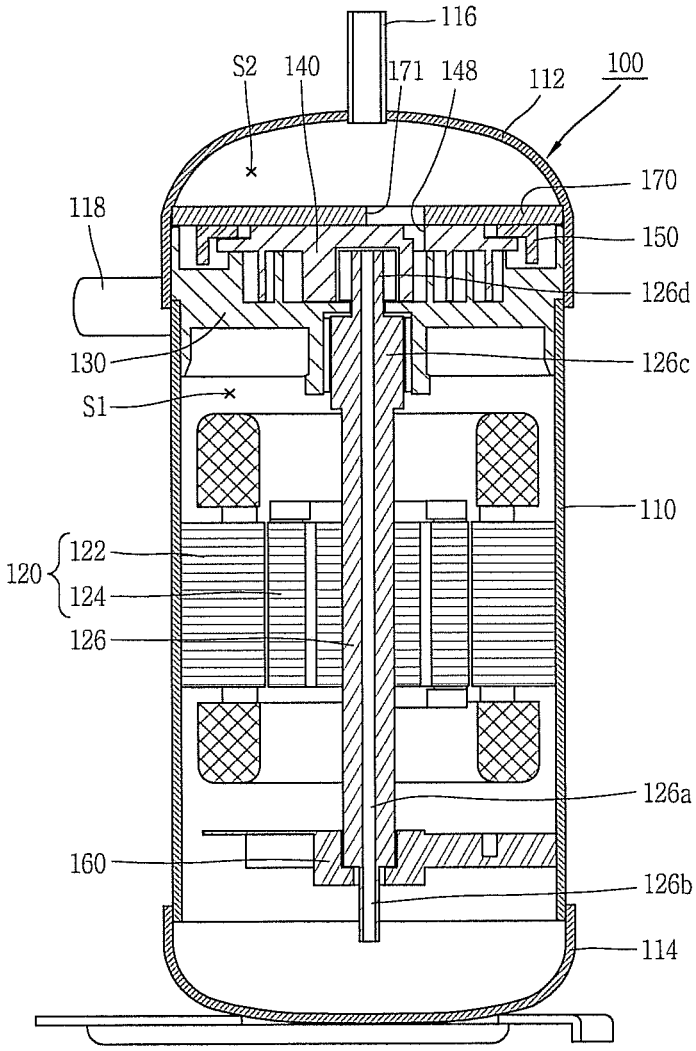
FIG. 1 is a sectional view of an inner structure of a scroll compressor in accordance with one exemplary embodiment as broadly described herein.
Figure 2:
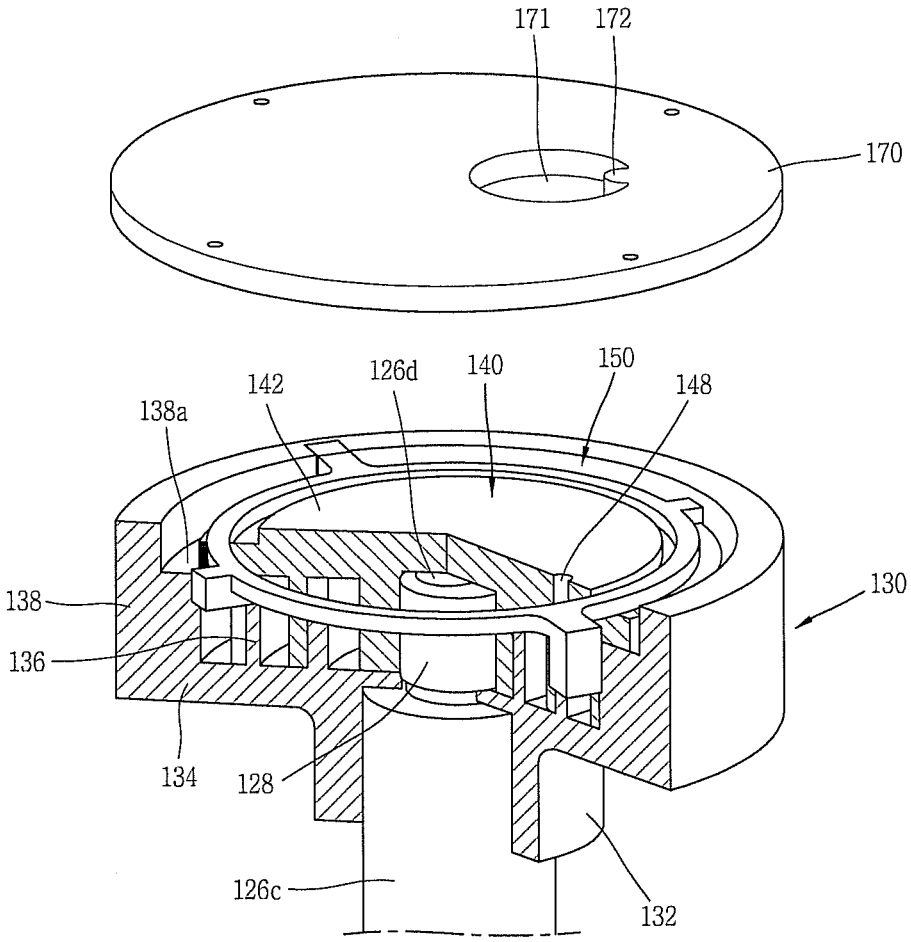
FIG. 2 is a partial cutaway view of a compression unit of the exemplary embodiment shown in FIG. 1.

Performance provided by a scroll compressor may be dependent on shapes of the fixed wrap and the orbiting wrap. For example, the fixed wrap and the orbiting wrap may have an involute curve shape which may correspond to a track drawn by an end of a thread when unwinding the thread wound around a basic circle with a predetermined radius. When such an involute curve shape is used, the wrap may have a uniform thickness and accordingly a coefficient of volume change of the compression chamber during compressing process is constantly maintained. Hence, the number of turns of the wrap increases to obtain or sustain a sufficient compression ratio. However, this may cause the compressor to increase in size.

The orbiting scroll may include a disk, an orbiting wrap located at a first side of the disk, and a boss formed at a second side of the disk opposite the first side so as to be connected to a rotation shaft, which allows the orbiting scroll to perform an orbiting motion. Such a structure may allow the orbiting wrap to be contained on the surface of the disk, thereby reducing a diameter of the disk while obtaining the same compression ratio. However, a point of application of a repulsive force of a refrigerant upon compression may be spaced apart from a point of application of a reaction force applied to attenuate the repulsive force, causing the orbiting scroll to be inclined during operation, thereby generating more vibration or noise.

A scroll compressor in which a coupled portion of a rotation shaft and an orbiting scroll are provided at the same surface as an orbiting wrap may allow the repulsive force of the refrigerant and the reaction force to be applied to the same point so as to address the inclination of the orbiting scroll.

However, if a discharge hole is formed eccentric to an outside of an outer circumferential surface of the rotation shaft, the two compression chambers (hereinafter, a compression chamber formed between an inner surface of the fixed wrap and an outer surface of the orbiting wrap is referred to as a first compression chamber, and a compression chamber formed between an inner surface of the orbiting wrap and an outer surface of the fixed wrap is referred to as a second compression chamber) do not have the same compression ratio and have different time points when discharging is started (initiated). Accordingly, in this situation, pressure at the moment when a refrigerant is discharged through the discharge hole is lowered as compared with pressure at a discharging side (hereinafter, referred to as discharge pressure) and thus the refrigerant discharged to the discharge side may flow back into the compression chamber, causing a recompression loss. A check valve may be installed at the discharge hole to prevent this refrigerant backflow. However, when the check valve is open or closed, valve noise is generated, which increases compressor noise. Furthermore, this type of check valve may be easily damaged, thereby lowering reliability of the compressor and increasing the fabricating cost of the compressor.

As shown in FIG. 1, a scroll compressor 100 in accordance with an exemplary embodiment as broadly described herein may include a casing 110 having a cylindrical shape, and an upper shell 112 and a lower shell 114 for covering upper and lower portions of the casing 110. The upper and lower shells 112 and 114 may be welded to the casing 110 so as to define a single hermetic space together with the casing 110. Other attachment mechanisms may also be appropriate.

A discharge pipe 116 may be connected to an upper side of the upper shell 112. The discharge pipe 116 may act as a path through which a compressed refrigerant is discharged to the outside. An oil separator (not shown) for separating oil mixed with the discharged refrigerant may be connected to the discharge pipe 116. A suction pipe 118 may be installed at a side surface of the casing 110. The suction pipe 118 may act as a path through which a refrigerant to be compressed is introduced. In the exemplary embodiment shown in FIG. 1, the suction pipe 118 is located at an interface between the casing 110 and the upper shell 116. However, other positions for the suction pipe 118 may also be appropriate. In addition, the lower shell 114 may function as an oil chamber for storing oil, which is supplied to make the compressor work smoothly.

A motor 120 may be installed at an approximately central portion within the casing 110. The motor 120 may include a stator 122 fixed to an inner surface of the casing 110, and a rotor 124 located within the stator 122 and rotatable by interaction with the stator 122. A rotation shaft 126 may be disposed in the center of the rotor 124 so as to be rotatable together with the rotor 124.

An oil passage 126*a* may be formed in the center of the rotation shaft 126 along a lengthwise direction of the rotation shaft 126. An oil pump 126*b* for pumping up oil stored in the lower shell 114 may be installed at a lower end portion of the rotation shaft 126. The oil pump 126*b* may be, for example, a spiral recess or a separately installed impeller in the oil passage 126*a*, or a separately installed pump.

Figure 3:
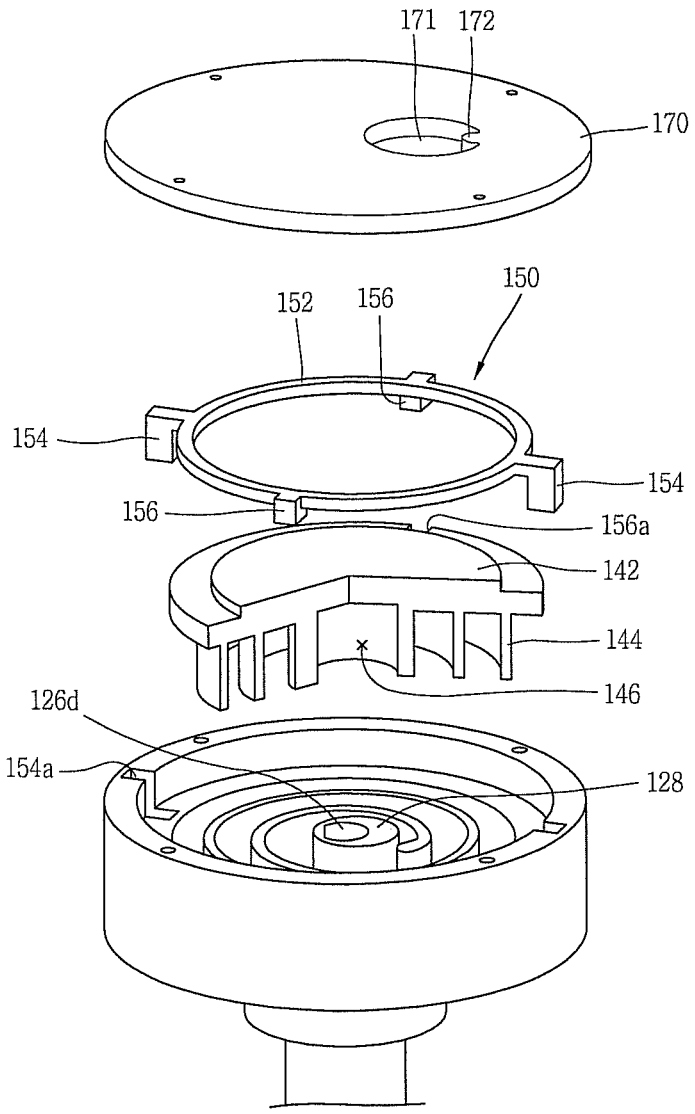
FIG. 3 is a disassembled perspective view of the compression unit shown in FIG. 2.
Figure 4:
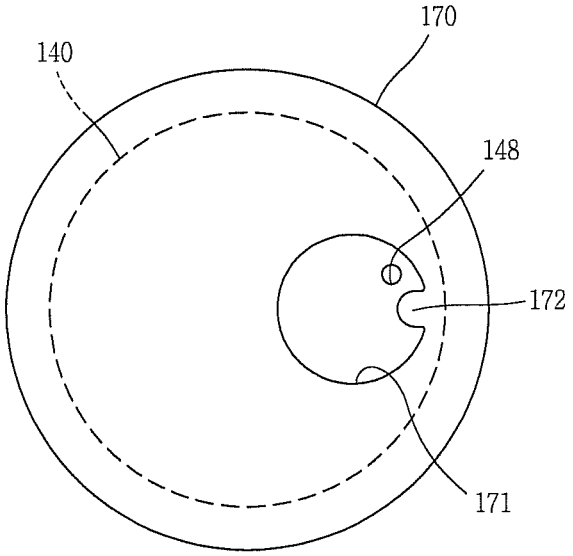
FIG. 4 is a planar view of an upper bearing having a blocking portion in the compression unit shown in FIG. 2.

An extended diameter part 126*c*, which is inserted in a boss formed in a fixed scroll to be explained later, may be disposed at an upper end portion of the rotation shaft 126. The extended diameter part 126*c* may have a diameter greater than other parts of the shaft 126. A pin portion 126*d* may be formed at an end of the extended diameter part 126*c*. In alternative embodiments, the entire rotation shaft 126 may have a substantially constant diameter. An eccentric bearing 128 may be inserted onto the pin portion 126*d*. Referring to FIG. 3, the eccentric bearing 128 may be eccentrically coupled to the pin portion 126*d*. A coupled portion between the pin portion 126*d* and the eccentric bearing 128 may have a "D" shape such that the eccentric bearing 128 cannot be rotated with respect to the pin portion 126*d*.

A fixed scroll 130 may be mounted at an interface area between the casing 110 and the upper shell 112. The fixed scroll 130 may have an outer circumferential surface which is shrink-fitted between the casing 110 and the upper shell 112. Alternatively, the fixed scroll 130 may be welded to the casing 110 and the upper shell 112.

A boss 132, in which the rotation shaft 126 is inserted, may be formed at a lower surface of the fixed scroll 130. A through hole through which the pin portion 126*d* of the rotation shaft 126 is inserted may be formed through an upper surface (see FIG. 1) of the boss 132. Accordingly, the pin portion 126*d* may protrude to an upper side of a disk 134 of the fixed scroll 130 through the through hole.

A fixed wrap 136, which is engaged with an orbiting wrap so as to define compression chambers, may be formed at an upper surface of the disk 134. A side wall 138 may be located at an outer circumferential portion of the disk 134. The side wall 138 may define a space for housing an orbiting scroll 140 to be explained later and be contactable with an inner circumferential surface of the casing 110. An orbiting scroll support 138*a*, on which an outer circumferential portion of the orbiting scroll 140 is received, may be formed inside an upper end portion of the side wall 138. A height of the orbiting scroll support 138*a* may be substantially the same height as the fixed wrap 136 or a slightly higher than the fixed wrap 136, such that an end of the orbiting wrap can contact a surface of the disk 134 of the fixed scroll 130.

The orbiting scroll 140 may be disposed on the fixed scroll 130. The orbiting scroll 140 may include a disk 142 having an approximately circular shape and an orbiting wrap 144 engaged with the fixed wrap 136. A rotation shaft coupling portion 146 having an approximately circular shape may be formed at a central portion of the disk 142 such that the eccentric bearing 128 may be rotatably inserted therein. An outer circumferential portion of the rotation shaft coupling portion 146 may be connected to the orbiting wrap 144 so as to define compression chambers together with the fixed wrap 136 during compression.

The eccentric bearing 128 may be inserted into the rotation shaft coupling portion 146, the end portion of the rotation shaft 126 may be inserted through the disk 134 of the fixed scroll 130, and the orbiting wrap 144, the fixed wrap 136 and the eccentric bearing 128 may be stacked in a lateral direction of the compressor and inter-engaged. During compression, a repulsive force of a refrigerant may be applied to the fixed wrap 136 and the orbiting wrap 144, while a compression force as a reaction force against the repulsive force may be applied between the rotation shaft coupling portion 146 and the eccentric bearing 128. As such, when a shaft is partially inserted through a disk and overlaps with a wrap, the repulsive force of the refrigerant and the compression force may be applied to the same side surface, thereby being attenuated by each other. Consequently, the orbiting scroll 140 is not necessarily inclined due to the compression force and the repulsive force. Alternatively, an eccentric bushing may be installed instead of the eccentric bearing. In this example, an inner surface of the rotation shaft coupling portion 146, in which the eccentric bushing is inserted, may be specifically processed to serve as a bearing. Additionally, a separate bearing may be installed between the eccentric bushing and the rotation shaft coupling portion.

A discharge hole 148, through which a compressed refrigerant may flow into the casing 110, may be formed through the disk 142. The position of the discharge hole 148 may be determined taking various factors into consideration, such as, for example, required discharge pressure and the like. Here, as the rotation shaft coupling portion 146 is formed at the central portion of the orbiting scroll 140, the discharge hole 148 may be formed near an outer circumferential surface of the rotation shaft coupling portion 146.

In one embodiment, the discharge hole 148 may communicate simultaneously with both compression chambers. In alternative embodiments, to the discharge hole 148 may communicate with a compression chamber having a higher compression ratio.

An Oldham ring 150 for preventing rotation of the orbiting scroll 140 may be installed on the orbiting scroll 140. The Oldham ring 150 may include a ring part 152 having an approximately circular shape and inserted on a rear surface of the disk 142 of the orbiting scroll 140, and a pair of first keys 154 and a pair of second keys 156 protruding from one side surface of the ring part 152. The first keys 154 may protrude beyond an outer circumferential portion of the disk 142 of the orbiting scroll 140, so that they may be inserted into first key recesses 154*a* formed in an upper end of the side wall 138 of the fixed scroll 130 and the orbiting scroll support 138*a*. In addition, the second keys 156 may be inserted into second key recesses 156*a* formed in the outer circumferential portion of the disk 142 of the orbiting scroll 140.

Each of the first key recesses 154*a* may have a vertical portion extending vertically in the side wall 138 and a horizontal portion extending perpendicular to the vertical portion. During an orbiting motion of the orbiting scroll 140, a lower end portion of each first key 154 remains inserted in the horizontal portion of the corresponding first key recess 154*a* while an outer radial end portion of the first key 154 may be separated from the vertical portion of the first key recess 154*a*. Such an arrangement may allow reduction of a diameter of the fixed scroll 130.

A clearance, or air gap, corresponding to an orbiting radius may be provided between the disk 142 of the orbiting scroll 140 and an inner wall of the fixed scroll 130. If the keys of an Oldham ring are coupled to a fixed scroll in a radial direction, key recesses formed at the fixed scroll would typically be longer than at least the orbiting radius in order to prevent the Oldham ring from being separated from the key recesses during orbiting motion. However, this structure may cause an increase in the size of the fixed scroll.

On the other hand, as shown in the exemplary embodiment, if the key recess 156*a* extends down to a lower side of a space between the disk 142 of the orbiting scroll 140 and the orbiting wrap 144, a sufficient length of the key recess 156*a* may be ensured without increasing the size of the fixed scroll 130.

In addition, in the exemplary embodiment, all the keys 154, 156 of the Oldham ring 150 are formed such that they all extend essentially downward, away from one side surface of the ring part 152. This structure may reduce the overall vertical height of a compression unit as compared to forming keys that extend upward/downward from both side surfaces.

A lower frame 160 for rotatably supporting a lower end portion of the rotation shaft 126 may be installed at a lower portion of the casing 110, and an upper frame 170 for supporting the orbiting scroll 140 and the Oldham ring 150 may be installed on the orbiting scroll 140.

A discharge passage 171 may be formed at a central portion of the upper frame 170. The discharge passage 171 may communicate with the discharge hole 148 of the orbiting scroll 140 to guide the compressed refrigerant to be discharged into the discharging space S2 of the upper shell. A blocking portion 172 may protrude from an inner circumferential surface of the discharge passage 171.

In a scroll compressor having the structure described above, the first and second compression chambers may have different compression ratios and different time points when initiating (starting) a discharging operation. And, at the moment when the discharging is started, pressure of a refrigerant may be instantaneously lowered with respect to pressure of a discharging space. Accordingly, a part of the refrigerant discharged into the discharging space may instantaneously flow back into the compression chamber due to a pressure difference, and accordingly be recompressed, which may cause a loss of the refrigerant.

In certain situations, a check valve may be provided at the discharge hole to prevent the backflow of refrigerant. However, the check valve may increase overall compressor noise due to valve noise, may lower reliability of the compressor due to valve damage and my increase fabricating cost due to the addition of the valve.

The exemplary embodiment shown in FIGS. 4-7 may provide a structure that prevents refrigerant discharged into a discharging space from flowing back into a compression chamber by temporarily blocking a discharge hole without installation of a check valve.

As shown in FIGS. 4 to 7, the upper frame 170, as aforementioned, may have the form of a flat panel (plate) and may include the discharge passage 171 formed at its central portion. The discharge passage 171 may be wide enough to accommodate the discharge hole 148 of the orbiting scroll 140 throughout an orbiting path, namely, as wide enough to allow the discharge hole 148 to perform an orbiting motion within an area of the discharge passage 171 in every range of the discharge hole 148 even if the discharge hole 148 orbits with respect to the discharge passage 171 of the upper frame 170 in response to the orbiting motion of the orbiting scroll 140. Consequently, refrigerant discharged through the discharge hole 148 may be discharged immediately into the discharging space S2 without passage resistance during the orbiting motion of the discharge hole 148, thereby preventing compression loss.

Figure 5:
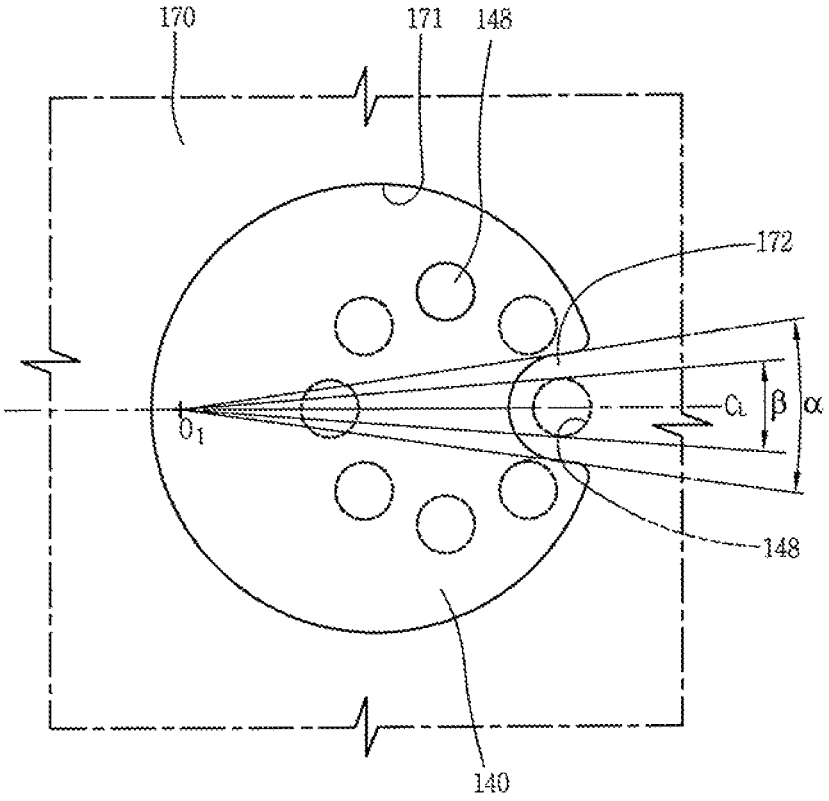
FIG. 5 is a planar view of one exemplary embodiment of the blocking portion shown in FIG. 4.
Figure 6:
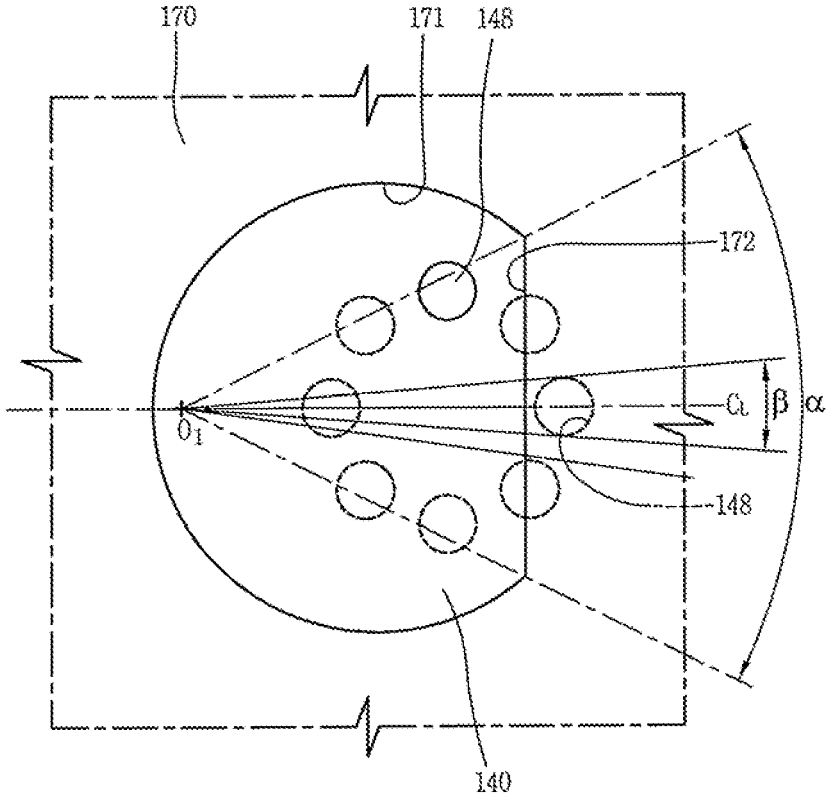
FIG. 6 is a planar view of another exemplary embodiment of the blocking portion shown in FIG. 4.

A blocking portion 172 may be formed at an inner circumferential surface of the discharge passage 171 so as to selectively block the discharge hole 148. In one embodiment, the blocking portion 172, as shown in FIG. 5, may radially protrude from the inner circumferential surface of the discharge passage 171 toward the center of the discharge passage 171. In alternative embodiments, the blocking portion 172 may be formed, as shown in FIG. 6, in a plate-like shape by connecting two predetermined portions of the inner circumferential surface of the discharge passage 171. Other configurations/arrangements may also be appropriate.

The blocking portion 172 may obscure the discharge hole 148 entirely or partially at the moment when pressure of a refrigerant discharged from the compression chamber becomes lower than pressure of a refrigerant filled in the discharging space S2, namely, at the moment of starting discharging. However, the blocking portion 172 may be formed to obscure the entire outlet 148 at the moment when the pressure of the refrigerant discharged from the compression chamber becomes lower than the pressure of the refrigerant filled in the discharging space S2 to most effectively prevent the refrigerant within the discharging space S2 from flowing back into the compression chamber and to minimize a recompression loss of the compressor accordingly.

In order to form the blocking portion 172 to obscure essentially the entire outlet, a range of the blocking portion 172 may be defined. That is, assuming that a line for connecting an orbiting center O of the orbiting scroll and the center of the discharge hole 148 at the moment of starting a discharging operation is a discharging start line CL, the center of the blocking portion 172 may be arranged on the discharging start line CL at the moment of starting the discharging operation. Also, assuming that an angle defined by respectively connecting the orbiting center O of the orbiting scroll and the two ends of the blocking portion is a blocking range angle $\alpha$, the blocking portion 172 may have a blocking range angle $\alpha$ great enough to obscure the entire outlet at the moment of discharging being started. If it is also assumed that an angle between two tangent lines generated by connecting the orbiting center O of the orbiting scroll 140 and a circumferential surface of the discharge hole 148 at the moment of discharging being started is a discharging start angle $\beta$, the discharging start angle $\beta$ may be smaller than the blocking range angle $\alpha$ at the moment of discharging being started.

Figure 7:
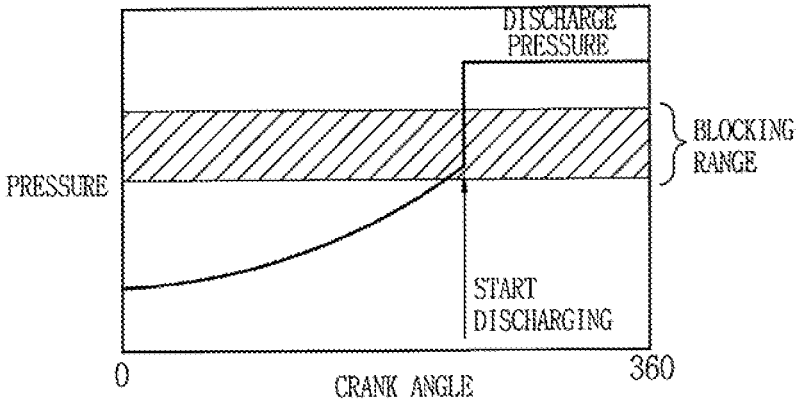
FIG. 7 is a graph of a relationship between pressure change and an installation position of the blocking portion upon starting discharging.

In a scroll compressor according to this exemplary embodiment, as shown in FIG. 7, the blocking portion 172 may obscure the discharge hole 148 at the moment when the refrigerant within the compression chamber begins to be discharged into the discharging space S2, thereby effectively preventing the refrigerant within the discharging space S2, which is under a relatively high pressure condition from flowing back into the compression chamber under a relatively low pressure condition. Furthermore, the blocking portion 172 may be configured to be situated at the center of the discharge hole 148 at the moment of discharging being started, which may result in more effective prevention of the refrigerant flowing from the discharging space S2 back into the compression chamber.

A width of the blocking portion 172 may be sufficient to obscure the discharge hole 148 at both forward and aft ends by a predetermined range when the refrigerant begins to be discharged through the discharge hole 148, whereby the refrigerant within the discharging space S2 may be prevented more effectively from flowing back into the compression chamber. However, if the blocking range a of the blocking portion 172 is too wide, a passage resistance may be caused during discharging. Also, if the blocking range a is too narrow, the refrigerant within the discharging space S2 may flow back into the compression chamber by detouring around both sides of the orbiting direction of the blocking portion 172. Therefore, a width of the blocking portion 172 may be established and/or adjusted in an appropriate range.

After discharging has started and the orbiting scroll 140 continues to orbit, the volume of the compression chamber is more reduced and pressure of the compression chamber is drastically increased. Accordingly, the discharge hole 148 is free from the blocking portion 172 and open with respect to the discharging space S2 at the moment when the pressure of the compression chamber becomes higher than the pressure of the discharging space S2 by a predetermined range. Thus, refrigerant within the compression chamber may be discharged into the discharging space S2, which is in a relatively low pressure state. In this instance, since the pressure of the compression chamber is higher than the pressure of the discharging space S2, the refrigerant in the discharging space S2 does not flow back into the compression chamber even if the discharge hole 148 is not blocked by the blocking portion 172.

Extending such a blocking portion from one of the fixed components, such as the upper frame, to temporarily block the discharge hole formed in the orbiting scroll at the moment of initiating discharging so as to prevent refrigerant backflow from the discharging space back into the compression chamber may be widely applied to various compressors, including scroll compressors having various scroll shapes as embodied and broadly described herein.

Figure 8A:
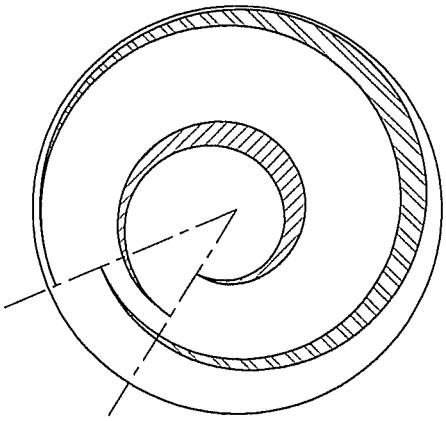
FIGS. 8A and 8B are planar views of first and second compression chambers right after suction and right before discharge, respectively, in a scroll compressor including an orbiting wrap and a fixed wrap having an involute curve shape.
Figure 8B:
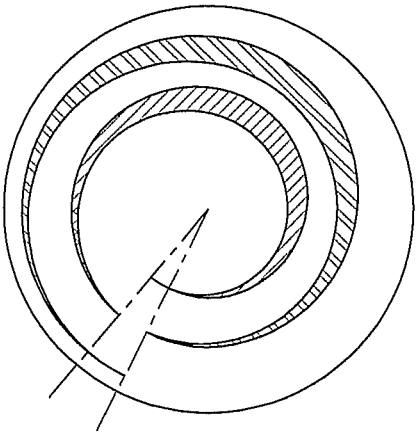

FIGS. 8A and 8B are planar views of a compression chamber right after a suction operation and a compression chamber right before a discharging operation in a scroll compressor having an orbiting wrap and a fixed wrap formed as an involute curve and having a shaft partially inserted through a disk. FIG. 8A shows the change of a first compression chamber defined between an inner surface of the fixed wrap and an outer surface of the orbiting wrap, and FIG. 8B shows the change of a second compression chamber defined between an inner surface of the orbiting wrap and an outer surface of the fixed wrap.

In such scroll compressors, a compression chamber is defined between two contact points generated by contact between the fixed wrap and the orbiting wrap having the involute curve shape, with the two contact points defining one compression chamber present on a line. In other words, the compression chamber may be present along 360° with respect to the center of the rotation shaft.

In this case, regarding a volume change of the first compression chamber, a compression chamber, located at the outside, right after a suction operation, moves toward the central portion in response to the orbiting motion of the orbiting scroll, and accordingly the volume of the first compression chamber is gradually reduced. Thus, when arriving at an outer circumferential portion of a rotation shaft coupling portion located at the center of the orbiting scroll, the first compression chamber has a minimum volume value. For the fixed wrap and the orbiting wrap having the involute curve shape, the volume reduction rate linearly decreases as a rotation angle of the rotation shaft increases. Hence, to acquire a high compression ratio, the compression chamber should move as close to the center as possible. However, when the rotation shaft is present at the central portion, the compression chamber may only move up to the outer circumferential portion of the rotation shaft. Accordingly, the compression ratio is lowered. A compression ratio of about 2.13 is exhibited in FIG. 8A.

Figure 9A:
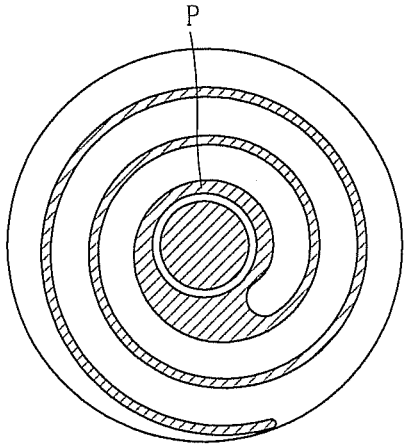
FIGS. 9A and 9B are planar views of an orbiting wrap in a scroll compressor including an orbiting wrap and a fixed wrap having another involute curve shape.
Figure 9B:
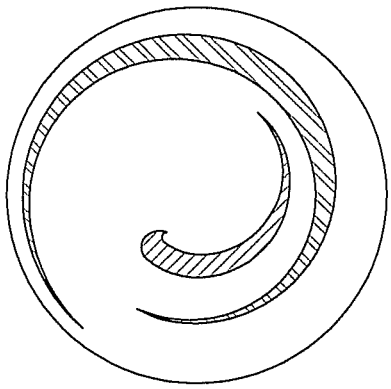

The second compression chamber shown in FIG. 8B has a much lower compression ratio of about 1.46 than the first compression chamber. However, regarding the second compression chamber, if the shape of the orbiting scroll is changed such that a connected portion between a rotation shaft coupling portion and the orbiting wrap is formed in an arcuate shape as shown in FIG. 9A, a compression path of the second compression chamber until before a discharging operation may be extended, thereby increasing the compression ratio up to about 3.0. In this case, the second compression chamber may be in the range less than 360° right before the discharging operation. However, this method may not be applied to the first compression chamber.

Therefore, when the fixed wrap and the orbiting wrap have the involute curve shape, a compression ratio of the second compression chamber may be as high as possible but the first compression chamber may not. Also, when the two compression chambers have a significant difference in their compression ratios, it may adversely affect the operation of the compressor.

FIGS. 10A to 10E show a process of determining shapes of the fixed wrap and the orbiting wrap in which a solid line indicates a curve generated for the first compression chamber and a dotted line indicates a curve generated for the second compression chamber.

The generated curve refers to a track drawn by a particular shape during movement. The solid line indicates a track drawn by the first compression chamber during suction and discharge operations, and the dotted line indicates the track of the second compression chamber. Hence, if the generated curve is extended outward from its two opposite sides along the orbiting radius of the orbiting scroll based upon the solid line, it exhibits the shapes of an inner side surface of the fixed wrap and an outer side surface of the orbiting wrap. If the generated curve is extended outward to its two opposite sides based upon the dotted line, it exhibits the shapes of an outer side surface of the fixed wrap and an inner side surface of the orbiting wrap.

Figure 10A:
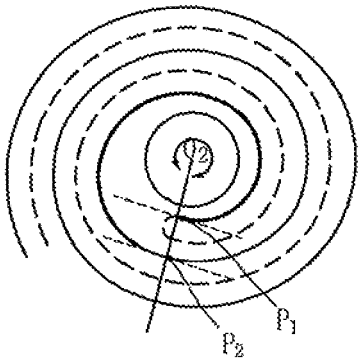
FIGS. 10A-10E illustrate a process for obtaining generating curves in the exemplary scroll compressor shown in FIG. 1.
Figure 10B:
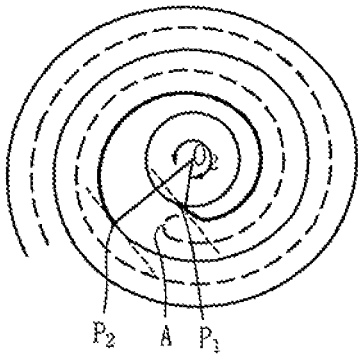

FIG. 10A shows a curve corresponding to having a wrap shape shown in FIG. 9A. Here, a bold line corresponds to the first compression chamber right before a discharge operation. As shown, a start point and an end point are present on the same line. In this case, it may be difficult to achieve a sufficient compression ratio. Thus, as shown in FIG. 10B, an end portion of the bold line, the outer end portion, is transferred in a clockwise direction along the curve and the other end portion, the inner end portion, is transferred up to a point to contact the rotation shaft coupling portion. That is, a portion of the curve, adjacent to the rotation shaft coupling portion, may be curved to have a smaller radius of curvature.

As described above, the compression chamber is defined by two contact points at which the orbiting wrap and the fixed wrap contact each other. The two ends of the bold line in FIG.

10A correspond to the two contact points. Normal vectors at the respective contact points are in parallel to each other according to the operating algorithm of the scroll compressor. Also, the normal vectors are in parallel to a line connecting a center of the rotation shaft and a center of the eccentric bearing. For a fixed wrap and an orbiting wrap having an involute curve shape, the two normal vectors are in parallel to each other and also present on the same line as shown in FIG. 10A.

That is, if it is assumed that the center of the rotation shaft coupling portion 146 is O and two contact points are P1 and P2, then P2 is located on a line connecting O and P1, as shown in FIG. 10A. If it is assumed that a larger angle of the two angles formed by lines OP1 and OP2 is α, α is 360°. In addition, if it is assumed that a distance between the normal vectors at P1 and P2 is l, l is 0.

When P1 and P2 are transferred more internally along the curves, the compression ratio of the first compression chamber may be improved. To this end, when P2 is transferred toward the rotation shaft coupling portion 146, namely, the curve for the first compression chamber is transferred by turning toward the rotation shaft coupling portion 146, P1, which has the normal vector in parallel to the normal vector at P2, then rotates in a clockwise direction from the position shown in FIG. 10A to the position shown in FIG. 10B, thereby being located at the rotated point. As described above, the first compression chamber is reduced in volume as it is transferred more internally along the generating curve. Hence, the first compression chamber shown in FIG. 10B may be transferred more internally as compared to FIG. 10A, and further compressed a corresponding amount, thereby obtaining an increased compression ratio.

Figure 10C:
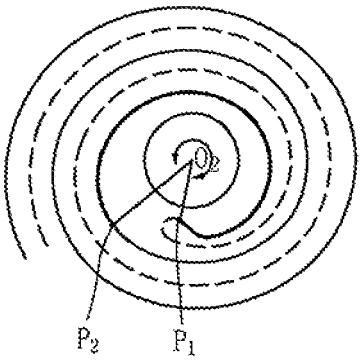
Figure 10D:
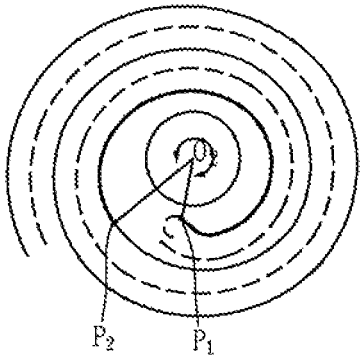

Here, referring to FIG. 10B, the point P1 may be considered excessively close to the rotation shaft coupling portion 146. Accordingly the rotation shaft coupling portion 146 may have to become thinner to accommodate this. Hence, the point P1 is transferred back so as to modify the curve as shown in FIG. 10C. In FIG. 10C, the curves of the first and second compression chambers may be considered to be excessively close to each other, which corresponds to an excessively thin wrap thickness or renders it physically too difficult to form the wrap(s). Thus, as shown in FIG. 10D, the curve of the second compression chamber may be modified such that the two curves maintain a predetermined interval therebetween.

Figure 10E:
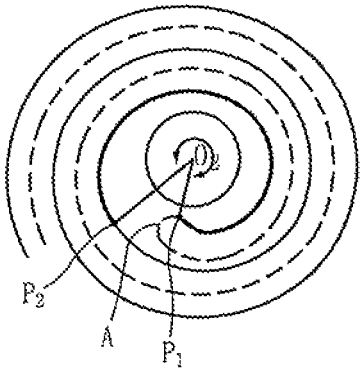
Figure 11:
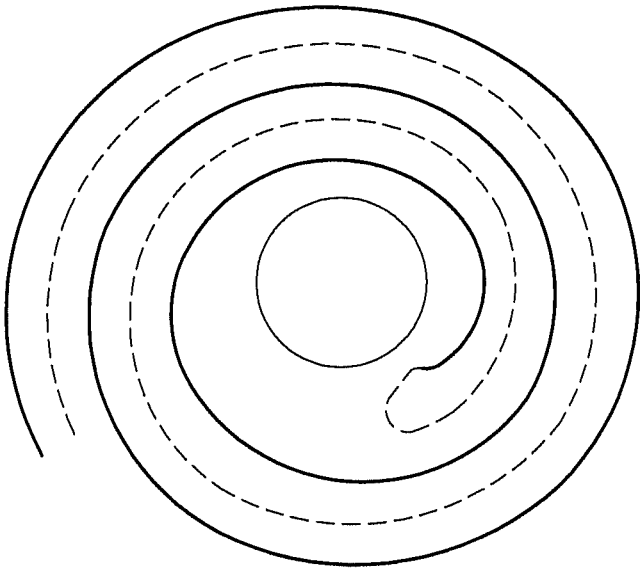
FIG. 11 is a planar view of final curves generated by the process shown in FIGS. 10-A-10E.

Furthermore, the generated curve of the second compression chamber may be modified, as shown in FIG. 10E, such that an arcuate portion C located at the end of the curve of the second compression chamber may contact the curve of the first compression chamber. The generated curves may be modified to continuously maintain a predetermined interval therebetween. When a radius of the arcuate portion C of the curve of the second compression chamber is increased to ensure a wrap rigidity at the end of the fixed wrap, curves generated having the shape shown in FIG. 11 may be acquired.

Figure 12:
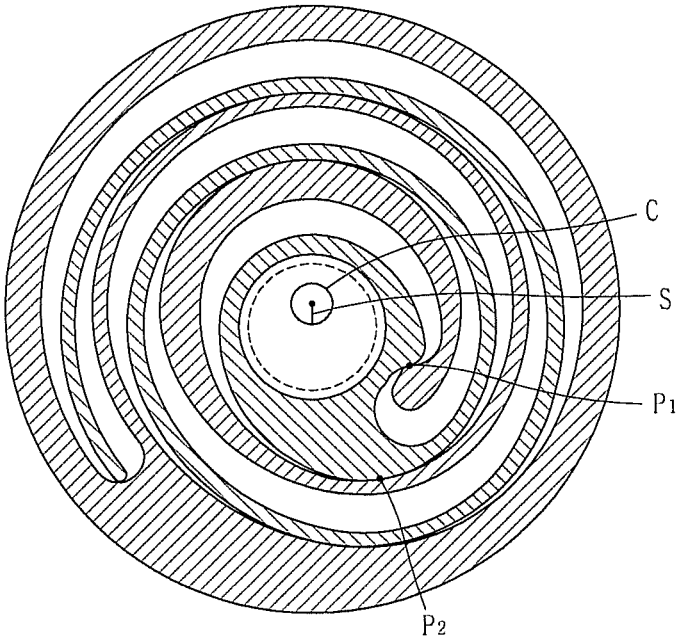
FIG. 12 is a planar view of an orbiting wrap and a fixed wrap formed by the curve shown in FIG. 11.

FIG. 12 shows a position of the orbiting wrap at a time point of initiating the discharge operation in the first compression chamber. The point P1 in FIG. 12 indicates a point within two contact points defining a compression chamber, at the moment when initiating discharging in the first compressor chamber. Line S is a virtual line for indicating a position of the rotation shaft and Circle C is a track drawn by the line S. Hereinafter, the crank angle is set to 0° when the line S is present in a state shown in FIG. 12, namely, when initiating discharging, set to a negative (−) value when rotated counterclockwise, and set to a positive (+) value when rotated clockwise.

Figure 13:
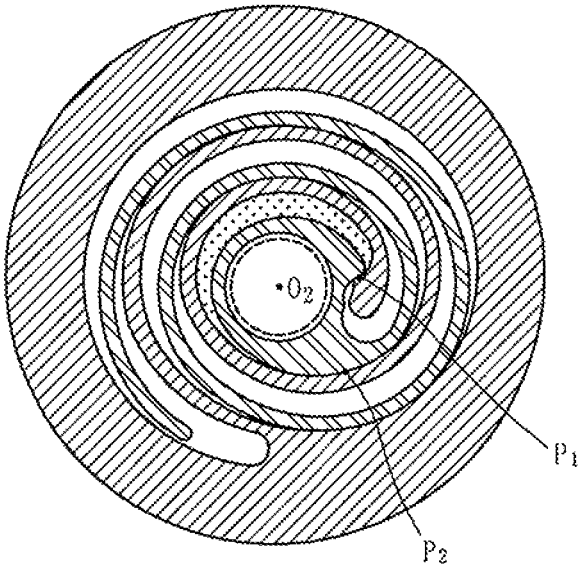
FIG. 13 is a planar view of an orbiting wrap and a fixed wrap obtained by another set of generating curves.
Figure 14:
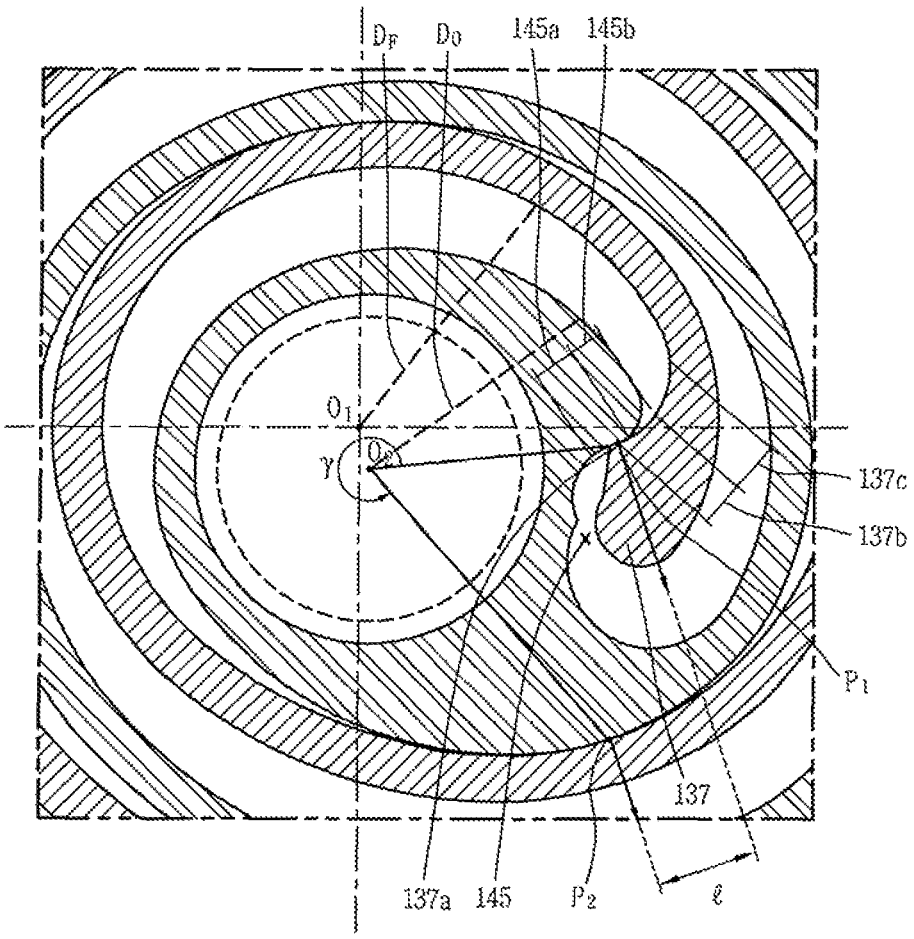
FIG. 14 is an enlarged planar view of a central portion of FIG. 10.

Referring to FIGS. 12, 13 and 14, it can be exhibited that an angle α defined by the two lines which respectively connect the two contact points P1 and P2 to the center O of the rotation shaft coupling portion is smaller than 360°, and a distance l between the normal vectors at each of the contact points P1 and P2 is greater than 0. Accordingly, the first compression chamber right before a discharge operation may have a smaller volume than that defined by the fixed wrap and the orbiting wrap having the involute curve shape, which results in an increase in the compression ratio. In addition, the orbiting wrap and the fixed wrap shown in FIG. 12 have a shape in which a plurality of arcs having different diameters and origins are connected and the outermost curve may have an approximately oval shape with a major axis and a minor axis.

Figure 15:
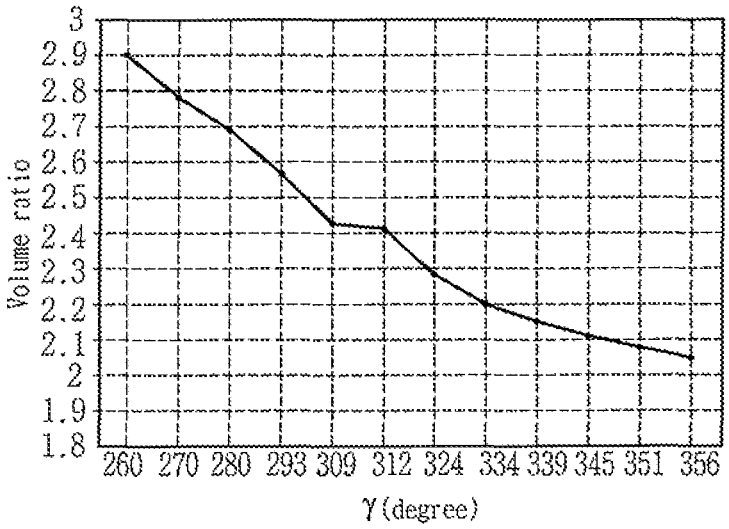
FIG. 15 is a graph of a relationship between an angle $\alpha$ and a compression ratio.

In the exemplary embodiment, the angle α may be in the range of, for example, 270 to 345°. FIG. 15 is a graph showing the angle α and a compression ratio. From the perspective of improvement of a compression ratio, it may be advantageous to set the angle α to have a low value. However, if the angle α is smaller than 270°, it may make mechanical fabrication, production and assembly difficult and increase a price of a compressor. If exceeding 345°, the compression ratio may be lowered below 2.1, thereby failing to provide a sufficient compression ratio.

The fixed wrap and the orbiting wrap shown in FIGS. 13 and 14 may have different curves (shapes) from the involute curve shape. If it is assumed that the center of the rotation shaft coupling portion 146 is O and two contact points between the fixed and orbiting wraps are P1 and P2, an angle α defined by two lines which respectively connect the two contact points P1 and P2 to the center O of the rotation shaft coupling portion is less than 360°, and a distance l between normal vectors at each of the contact points P1 and P2 is greater than O. Accordingly, the first compression chamber right before a discharging operation may have a smaller volume than that defined by the fixed wrap and the orbiting wrap having the involute curve shape, which results in an increase in the compression ratio. In addition, the orbiting wrap and the fixed wrap shown in FIG. 13 have a shape in which a plurality of arcs having different diameters and origins are connected and the outermost curve may have an approximately oval shape with a major axis and a minor axis.

A protruding portion 137 may protrude from near an inner end of the fixed wrap toward the rotation shaft coupling portion 146. A contact portion 137*a* may protrude from the protruding portion 137. That is, the inner end of the fixed wrap 130 may be thicker than other portions thereof. Accordingly, the wrap strength of the inner end of the fixed wrap, to which the strongest compression force is applied, may be improved, resulting in enhanced durability.

The thickness of the fixed wrap may be gradually decreased, starting from the inner contact point P1 of the two contact points P1 and P2 defining the first compression chamber upon initiating the discharging operation, as shown in FIG. 14. In particular, a first decrease part 137*b* may be formed adjacent to the contact point P1 and a second decrease part 137*c* may extend from the first decrease part 137*b*. A thickness reduction rate at the first decrease part 137*b* may be higher than that at the second decrease part 137*c*. After the second decrease part 137*c*, the fixed wrap may be increased in thickness within a predetermined interval.

Figure 16:
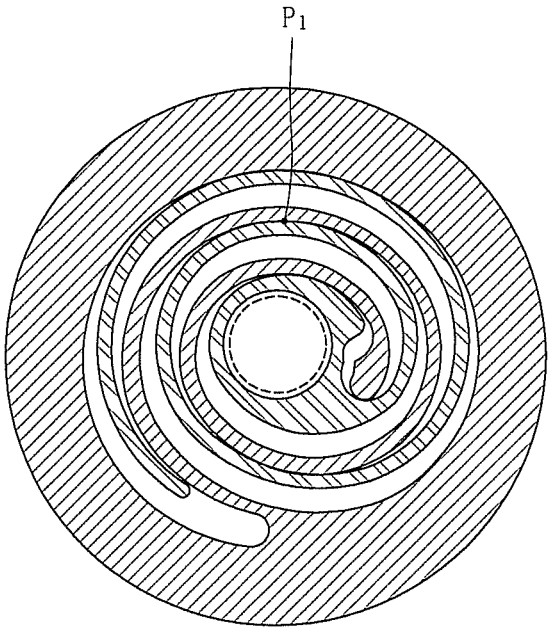
FIG. 16 is a planar view showing a state in which the orbiting wrap of FIG. 10 is located at a 150° position prior to initiating a discharging operation.

If it is assumed that a distance between an inner surface of the fixed wrap and a center O' of the rotation shaft is DF, then DF may be increased and then decreased as it proceeds away from P1 in a counterclockwise direction (based on FIG. 14). Such an interval is shown in FIG. 16, which is a planar view of the position of the orbiting wrap 150° before initiating the discharging operation. If the rotation shaft rotates 150° more from the state of FIG. 16, it reaches the state shown in FIG. 13. Referring to FIG. 16, the contact point is located above the rotation shaft coupling portion 146, and DF is increased and then decreased at the interval from P1 of FIGS. 13 to P1 of FIG. 16.

The rotation shaft coupling portion 146 may be provided with a recess portion 145 engaged with the protruding portion 137. One side wall of the recess portion 145 may contact the contact portion 137*a* of the protruding portion 137 to define one contact point of the first compression chamber. If it is assumed that a distance between the center of the rotation shaft coupling portion 146 and an outer circumferential portion of the rotation shaft coupling portion 146 is Do, then Do may be increased and then decreased at the interval between P1 of FIGS. 13 and P1 of FIG. 16. Similarly, the thickness of the rotation shaft coupling portion 146 may also be increased and then decreased at the interval between P1 of FIGS. 13 and P1 of FIG. 16.

The one side wall of the recess portion 145 may include a first increase part 145*a* in which a thickness is increased at a relatively high rate, and a second increase part 145*b* extending from the first increase part 145*a* in which a thickness is increased at a relatively low rate. These may correspond to the first decrease part and the second decrease part of the fixed wrap. The first increase part, the first decrease part, the second increase part and the second decrease part may be obtained by turning the generating curve toward the rotation shaft coupling portion 146. Accordingly, the inner contact point P1 defining the first compression chamber may be located at the first and second increase parts, and also the length of the first compression chamber right before the discharging operation may be shortened so as to enhance the compression ratio.

Another side wall of the recess portion 145 may have an arcuate shape. A diameter of the arc may be determined by the wrap thickness of the end of the fixed wrap and the orbiting radius of the orbiting wrap. When the thickness of the end of the fixed wrap increases, the diameter of the arc may increase. Accordingly, the thickness of the orbiting wrap near the arc may increase to provide for adequate durability and the compression path may also extend so as to increase the compression ratio of the second compression chamber.

Figure 17:
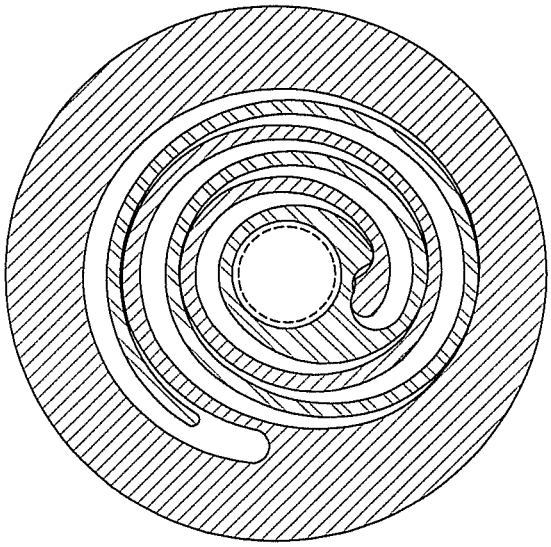
FIG. 17 is a planar view showing a time point when initiating a discharging operation in a second compression chamber in the embodiment of FIG. 10.

A central portion of the recess portion 145 may form a part of the second compression chamber. FIG. 17 is a planar view of a position of the orbiting wrap when initiating the discharging operation in the second compression chamber. Referring to FIG. 17, the second compression chamber contacts an arcuate side wall of the recess portion 145. As the rotation shaft rotates, one end of the second compression chamber may pass through the center of the recess portion 145.

In such scroll compressors having such various scroll shapes, when the blocking portion is formed at the fixed member adjacent to the discharge hole so as to temporarily block the discharge hole upon initiating discharging, the refrigerant discharged into the discharging space may be effectively prevented from flowing back into the compression chamber when discharging begins, without installation of a separate check valve. Consequently, it may be possible to prevent increases in overall compressor noise due to valve noise, lowering of reliability of the compressor due to valve damage, and increases in fabricating cost due to the addition of the valve.

In addition, as the blocking portion is installed at the discharge passage of a fixed component of the compressor such as the upper frame, a jumping phenomenon, in which pressure of a refrigerant approximately linearly compressed in the compression chamber is drastically increased upon initiating discharging, my be prevented. This may help stabilize motion of the orbiting scroll and prevent abrasion of a bearing surface of the compressor.

A scroll compressor is provided that is capable of preventing a refrigerant within a discharging space from flowing back into a compression chamber at the moment of discharging being started.

A scroll compressor as embodied and broadly described herein may include a fixed scroll having a fixed wrap, an orbiting scroll having an orbiting wrap, the orbiting wrap engaged with the fixed wrap to define first and second compression chambers in an outer surface and an inner surface, the orbiting scroll having a discharge hole through which a refrigerant compressed in the first and second compression chambers is discharged, a rotation shaft having an eccentric portion at one end thereof, the rotation shaft coupled to the orbiting scroll such that the eccentric portion overlaps the orbiting wrap in a lateral direction, and a driving unit configured to drive the rotation shaft, wherein a blocking portion is disposed to obscure a partial range of an orbiting path of the discharge hole.

The scroll compressor may also include a frame disposed at an opposite side to the fixed scroll with the orbiting scroll interposed therebetween to support the orbiting scroll. A discharge passage may be formed through the frame to communicate with the discharge hole, and the blocking portion may be integrally formed on an inner circumferential surface of the discharge passage.

The blocking portion may protrude from the inner circumferential surface of the discharge passage toward the center of the discharge passage.

The blocking portion may be formed by connecting predetermined portions on the inner circumferential surface of the discharge passage.

If it is assumed that a time point when a refrigerant is discharged through the discharge hole is a discharging start time point, the blocking portion may obscure the discharge hole at least at the discharging start time point.

If it is assumed that a line for connecting an orbiting center O of the orbiting scroll to the center of the discharge hole at the discharging start time point is a discharging start line CL, the center of the blocking portion may be present on the discharging start line at the discharging start time point.

If it is assumed that an angle defined by connecting the orbiting center O of the orbiting scroll to both ends of the blocking portion is a blocking range angle $\alpha$, the blocking portion may have a blocking range angle great enough to obscure the entire outlet at the discharging start time point.

If it is assumed that an angle between normal lines generated by connecting the orbiting center O of the orbiting scroll to a circumferential surface of the discharge hole at the discharging start time point is a discharging start angle $\beta$, the discharging start angle $\beta$ may be smaller than the blocking range angle $\alpha$ at the discharging start time point.

The first and second compression chambers may have different compression ratios, and the discharge hole may be allowed to first communicate with a compression chamber having a relatively high compression ratio.

The blocking portion may be configured to obscure a range from the time point of initiating the discharging operation in the compression chamber having the high compression ratio to a time point of both compression chambers communicating with each other.

The first compression chamber may be defined between two contact points P1 and P2 generated by contact between an inner surface of the fixed wrap and an outer surface of the orbiting wrap, and $\alpha<360°$ at least before initiating a discharge operation if an angle defined by two lines, which connect a center O of the eccentric portion to the two contact points P1 and P2, respectively, is $\alpha$.

In certain embodiments, $l>0$ if it is assumed that a distance between normal lines at the two contact points P1 and P2 is l.

A rotation shaft coupling portion into which the eccentric portion is coupled may be formed at a central portion of the orbiting scroll, a protrusion may be formed at an inner circumferential surface of an inner end portion of the fixed wrap, and a recess portion defining a compression chamber by contact with the protrusion may be formed at an outer circumferential surface of the rotation shaft coupling portion.

A scroll compressor in accordance with another exemplary embodiment as broadly described herein may include a hermetic container having a hermetic inner space, a fixed scroll fixed to an inner surface of the hermetic container and having a fixed wrap, an orbiting scroll having an orbiting wrap, the orbiting wrap engaged with the fixed wrap to define first and second compression chambers at an outer surface and an inner surface, the orbiting scroll having a discharge hole through which a refrigerant compressed in the first and second compression chambers is discharged, a frame installed at an opposite side to the fixed scroll with the orbiting scroll interposed therebetween to support the orbiting scroll, a rotation shaft having an eccentric portion at one end thereof, the eccentric portion being coupled to the orbiting scroll, and a driving unit coupled to the rotation shaft and disposed within an inner space of the hermetic container, wherein a discharge passage is formed at the frame to communicate with the discharge hole, and a blocking portion is formed at an inner circumferential surface of the discharge passage to obscure a partial range of an orbiting path of the discharge hole.

If it is assumed that a time point when a refrigerant is discharged through the discharge hole is a discharging start time point, the blocking portion may obscure the discharge hole at least at the discharging start time point.

A scroll compressor as embodied and broadly described herein may employ a blocking portion at a discharge passage of an upper frame communicating with a discharge hole so as to temporarily obscure the discharge hole at a discharging start time point when a refrigerant within a compression chamber is discharged, thereby preventing in advance the refrigerant discharged into a discharging space from flowing back into the compression chamber, without installation of a separate check valve. Accordingly, it may be possible to prevent in advance several problems, such as a noise increase in the compressor due to valve noise, lowering of reliability of the compressor due to valve damage and an increase in fabricating cost due to the addition of the valve.

Any reference in this specification to "one embodiment," "an embodiment," "example embodiment," etc., means that a particular feature, structure, or characteristic described in connection with the embodiment is included in at least one embodiment of the invention. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A scroll compressor, comprising:

a casing that defines an inner space;

a fixed scroll fixed in the inner space of the casing, the fixed scroll having a fixed wrap;

an orbiting scroll having an orbiting wrap engaged with the fixed wrap to form a compression space therebetween;

a shaft coupled to a driver that rotates the shaft and having an eccentric portion, wherein the eccentric portion is coupled to the orbiting scroll;

a frame fixed in the inner space of the casing above the orbiting scroll so as to divide the inner space into a discharge space above the frame and a suction space below the frame;

at least one discharge hole formed in the orbiting scroll to guide compressed refrigerant from the compression space to the discharge space; and a discharge passage formed in the frame, wherein a peripheral portion of the discharge passage is shaped such that the peripheral portion blocks the at least one discharge hole at a time point when discharging of refrigerant through the at least one discharge hole is initiated, wherein peripheral portion is configured to selectively block the at least one discharge hole formed in the orbiting scroll as the orbiting scroll moves with respect to the fixed scroll and the frame, and the peripheral portion is configured to fully block the at least one discharge hole at the time point when discharging of refrigerant through the at least one discharge hole is initiated.

2. The compressor of claim 1, wherein the discharge passage extends through the frame to provide communication between the discharge space and the at least one discharge hole.

3. The compressor of claim 2, wherein the peripheral portion comprises a protrusion provided along a peripheral edge of the discharge passage that extends toward a central portion of the discharge passage.

4. The compressor of claim 3, wherein the protrusion is defined by a line connecting two predetermined points on an inner circumferential surface of the discharge passage.

5. The compressor of claim 4, wherein the line connecting the two predetermined points on the inner circumferential surface of the discharge passage is a straight line or a curved line.

6. The compressor of claim 4, wherein a blocking angle is defined by an angle between lines connecting an orbiting center of the orbiting scroll to the two predetermined points the inner circumferential surface of the discharge passage, and wherein the blocking angle of the protrusion of the discharge passage is large enough to fully obscure the at least one discharge hole at the time point when discharging of refrigerant is initiated.

7. The compressor of claim 6, Wherein a discharging start angle is defined by an angle between normal lines generated by connecting the orbiting center of the orbiting scroll to opposite tangential surfaces of the at least one discharge hole at the time point when discharging of refrigerant is initiated, and wherein the discharging start angle is less than the blocking angle at the time point when discharging of refrigerant is initiated.

8. The compressor of claim 1, wherein a discharging start line is defined by a line connecting an orbiting center of the orbiting scroll to a center of the at least one discharge hole at the time point when discharging of refrigerant is initiated, and wherein a center of the peripheral portion is positioned on the discharging start line at the time point when discharging of refrigerant is initiated.

9. The compressor of claim 1, wherein the compression space formed between the fixed and orbiting wraps comprises first and second compression chambers having first and second compression ratios, respectively, the first compression ratio being higher than the second compression ratio, and wherein the at least one discharge hole first communicates with the first compression chamber having the higher compression ratio.

10. The compressor of claim 9, wherein the peripheral portion of the discharge passage is configured to block at least a portion of the at least one discharge hole from the time point when discharging of refrigerant is initiated in the first compression chamber having the higher compression ratio until a point at which the first and second compression chambers communicate with each other.

11. The compressor of claim 9, wherein the first compression chamber is defined between two contact points between an inner surface of the fixed wrap and an outer surface of the orbiting wrap, and wherein an angle defined by two lines that respectively connect a center of the eccentric portion to the two contact points is less than 360°.

12. The compressor of claim 11, wherein a distance between normal lines at the two contact points is greater than 0.

13. The compressor of claim 11, further comprising:

a rotational shaft coupling portion formed at a central portion of the orbiting scroll, wherein the eccentric portion of the shaft is coupled to the rotational shaft coupling portion;

a protruding portion formed at an inner circumferential surface of an inner end portion of the fixed wrap; and a recess formed at an outer circumferential surface of the rotational shaft coupling portion, wherein the protruding portion contacts the recess to form a compression chamber therebetween.

14. The compressor of claim 1, wherein the peripheral portion selectively opens and closes the at least one discharge hole without the use of at least one corresponding valve.

15. A scroll compressor, comprising:

a container having an inner space formed therein;

a fixed scroll fixed to an inner surface of the container;

an orbiting scroll having an orbiting wrap engaged with a fixed wrap of the fixed scroll to define first and second compression chambers therebetween;

a shaft having an eccentric portion at a first end that is coupled to the orbiting scroll, and a second end that is coupled to a driver that rotates the shaft;

a frame fixed to the inner surface of the container at one side of the fixed scroll such that the orbiting scroll is positioned between the fixed scroll and the frame;

a discharge hole formed in the orbiting scroll through which refrigerant compressed in the first and second compression chambers is discharged; and a discharge passage that extends through the frame to selectively communicate with the discharge hole, wherein a portion of the frame adjacent to a predetermined peripheral edge portion of the discharge passage defines a blocking portion wherein the discharge hole is partially opened, fully opened, or fully closed by the blocking portion, and wherein the blocking portion is configured to fully cover the at least one discharge hole at a time point when discharging of refrigerant through the at least one discharge hole is initiated.

16. The compressor of claim 15, wherein the blocking portion is defined by a line connecting two predetermined points on an inner circumferential surface of the discharge passage.

17. The compressor of claim 16, wherein first and second compression ratios are respectively generated in the first and second compression chambers, and wherein the blocking portion is configured to communicate with a compression chamber of the first and second compression chambers having a higher compression ratio and to close the discharge hole from the time point when discharging of refrigerant is initiated in the compression chamber having the higher compression ratio to a point at which the first and second compression chambers communicate with each other.

18. The compressor of claim 15, wherein a blocking angle is defined by an angle between lines connecting an orbiting center of the orbiting scroll to two predetermined points on an inner circumferential surface of the discharge passage, wherein the blocking portion of the discharge passage is large enough to fully close the discharge hole at the time point when discharging of refrigerant is initiated, and wherein a discharging start angle, defined by an angle between normal lines generated by connecting the orbiting center of the orbiting scroll to opposite tangential surfaces of the discharge hole at the time point when discharging of refrigerant is initiated, is less than the blocking angle at the time point when discharging of refrigerant is initiated.

* * * * *